United States Patent [19]

Sung

[11] Patent Number: 4,631,069

[45] Date of Patent: Dec. 23, 1986

[54] ANTI-WEAR ADDITIVES FOR ALCOHOL FUELS

[75] Inventor: Rodney L. Sung, Fishkill, N.Y.

[73] Assignee: Texaco Inc., White Plains, N.Y.

[21] Appl. No.: 746,816

[22] Filed: Jun. 20, 1985

[51] Int. Cl.[4] ..... C10L 1/22

[52] U.S. Cl. ..... 44/56; 44/63; 44/71

[58] Field of Search ..... 44/51, 53, 56, 71; 252/390, 392

[56] References Cited

U.S. PATENT DOCUMENTS

| | | | |
|---|---|---|---|
| 4,348,210 | 9/1982 | Sung | 252/392 |
| 4,384,872 | 5/1983 | Kester et al. | 44/56 |
| 4,419,105 | 12/1983 | Sung | 44/53 |

*Primary Examiner*—Mrs. Y. Harris-Smith

*Attorney, Agent, or Firm*—Robert A. Kulason; James J. O'Loughlin; Vincent A. Mallare

[57] ABSTRACT

A novel fuel composition contains methanol or methanol/gasoline blends plus, as a wear-inhibiting additive, a reaction product of polyoxyisopropylenediamine, maleic anhydride and N-alkyl-1,3-propane diamine.

16 Claims, No Drawings

ANTI-WEAR ADDITIVES FOR ALCOHOL FUELS

FIELD OF THE INVENTION

This invention relates to alcohols, and more particularly to alcohol-containing fuels characterized by a decreased ability to corrode/wear metal surfaces with which they come in contact.

BACKGROUND OF THE INVENTION

As is well known to those skilled in the art, alcohol substances such as methanol or methanol fuels may cause corrosion and wear of metal surfaces with which they come in contact.

This problem can be quite severe in internal combustion engines where alcohol-containing fuels are burned. It is, therefore, important to develop an additive to inhibit this problem causing wear and corrosion. In addition, it is imperative that all problems (i.e., storage tanks, lines, etc.) are overcome before the use of alcohol and alcohol-containing fuels becomes more prevalent.

Thus, it is an object of this invention to provide a novel additive for decreasing the corrosion/wear of alcohol compositions. Other objects will be apparent to those skilled in the art.

SUMMARY OF THE INVENTION

This invention provides a novel fuel composition for an internal combustion engine. The fuel composition comprises (a) a major portion of a fuel containing a $C_1$–$C_2$ alcohol and 0–50 volumes of gasoline per volume of alcohol; and (b) a minor wear-inhibiting amount of, as a wear-inhibiting additive, a condensate product of the process comprising:

(i) reacting a polyoxyisopropylenediamine

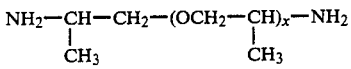

wherein x is a numeral of about 2 to about 68, with a dibasic acid anhydride, thereby forming a maleamic acid;

(ii) reacting said maleamic acid with an N-alkyl-alkylene diamine, thereby forming a condensate product; and (iii) recovering said condensate product.

DESCRIPTION OF THE INVENTION

The fuel for internal combustion engines which may be treated by the process of this invention may contain (1) at least one $C_1$–$C_2$ alcohol, e.g., ethanol or methanol, and (2) gasoline in an amount of 0 to 50 volumes per volume of alcohol. The fuel may be an alcohol-type fuel containing little or no hydrocarbon. Typical of such fuels are methanol, ethanol, and mixtures of methanol-ethanol, etc. Commercially available mixtures may be employed. The fuels which may be treated by the process of this invention also include the gasohols which may be formed by mixing 90–95 volumes of gasoline with 5–10 volumes of ethanol or methanol. A typical gasohol may contain 90 volumes of gasoline and 10 volumes of ethanol alcohol.

It is preferred that the fuels to be treated by the process of this invention be substantially anhydrous, i.e., that they contain less than about 0.3 (v)% water; typically, they may contain about 0.0001 to about 0.05 (v)%, preferably about 0.04 (v)% water. In accordance with the practice of the process of this invention, there may be added to the fuel a minor wear-inhibiting amount of, as a wear-inhibiting additive, a condensate product of the process comprising:

(1) reacting a polyoxyisopropylenediamine with a dibasic acid anhydride thereby forming a maleamic acid;

(2) reacting the maleamic acid with an N-alkyl-alkylene diamine, thereby forming a condensate product; and (3) recovering the condensate product.

The polyoxyisopropylenediamine may be represented by the formula:

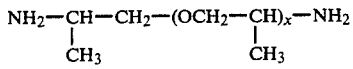

wherein x is a numeral of about 2 to about 68, and preferably a numeral of about 2 to about 33.

The molecular weight $\overline{M}_n$ of polyoxyisopropylenediamine may range from about 230 to about 2000. Examples of the polyoxyisopropylenediamine which may be employed herein include those listed below in Table I. These polyoxyisopropylene diamines are commercially available under the tradename of JEFFAMINE-D which are manufactured by Texaco Chemical Company of Houston, Tex.

TABLE I

A. JEFFAMINE D-230

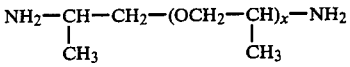

(where x is 2 or 3)

B. JEFFAMINE D-400

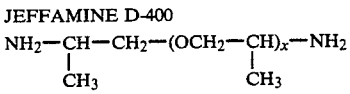

(where x is 5 or 6)

C. JEFFAMINE D-2000

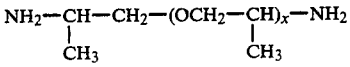

(where x is 33)

D. JEFFAMINE D-4000

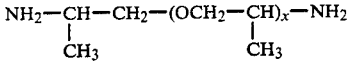

(where x is 68)

The dibasic acid anhydrides of the present invention, may be represented by the formula

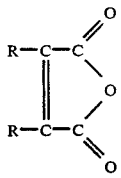

where R is H, $CH_3$— or $C_2H_5$—.

Accordingly, the dibasic acid anhydrides may include the following:

maleic anhydride alpha-methyl maleic anhydride alpha-ethyl maleic anhydride alpha, beta-dimethyl maleic anhydride The preferred dibasic acid anhydride is maleic anhydride.

The amines which may be employed in the present process include polyamines preferably diamines, which bear at least one primary amine-$NH_2$ group and at least one substituted primary amine group. The latter may be di-substituted, but more preferably it is mono-substituted. The hydrocarbon nucleus of the amine may be aliphatic or aromatic including alkyl, alkaryl, aralkyl, aryl, or cyclalkyl in nature. The preferred amine may be of the formula:

$$R'—NH—R''—NH_2$$

wherein R′ is a $C_8$–$C_{18}$ hydrocarbon group and R″ is a $C_1$–$C_3$ hydrocarbon group. In the preferred amines, i.e., mono-substituted primary amines. R′ may be an alkyl, alkaryl, aralkyl, aryl, or cycloalkyl hydrocarbon group and R″ may be an alkylene, aralkylene, alkarylene, arylene, or cycloalkylene hydrocarbon group.

Illustrative of the preferred N-alkyl-alkylene diamines include those which are commercially available under the tradename of DUOMEENS and manufactured by Akzo Chemie of Chicago, Ill. These preferred diamines are listed below in Table II.

TABLE II

A. The Duomeen O brand of N-oleyl-1,3-propane diamine.
B. The Duomeen S brand of N-stearyl-1,3-propane diamine.
C. The Duomeen T brand of N-tallow-1,3-propane diamine.
D. The Duomeen C brand of N-coco-1,3-propane diamine.

The most preferred diamine, R′—NH—R″—$NH_2$, is that where the R″ group is propylene, —$CH_2CH_2CH_2$— and the R′ group is a $C_8$–$C_{18}$ n-alkyl group.

It will be apparent to those skilled in the art that several reactants may be inert substituents which are typified by alkyl, alkoxy, halogen, nitro, cyano, haloalkyl, etc. It will also be apparent that the preferred compounds to be employed will be those which are soluble in the solvents compatible with the system in which the product is to be employed.

Typical solvents which may be employed include cyclohexane, xylene, mixture of xylene, and toluene and mixtures of toluene. The formulation of the desired additives may preferably be effected by placing equimolar quantities of polyoxyisopropylenediamine and a dibasic acid anhydride in a reaction vessel in an excess of solvent. A typical solvent (e.g., xylene) may be present in the amount of 5 to 500 parts depending upon the N-alkyl-alkylene diamine used. Typically, the reactions for preparing the additives may be as illustrated below.

In the process illustrated below, initially, maleic anhydride (A) is reacted with polyoxyisopropylenediamine (B) to form maleamic acid (C). Then, the maleamic acid (C) is reacted with an N-alkyl alkylene diamine (D) to form the condensate product (E) of polyoxyisopropylenediamine, maleic anhydride, and N-alkyl alkylene diamine. Accordingly, the condensate product (E) is recovered.

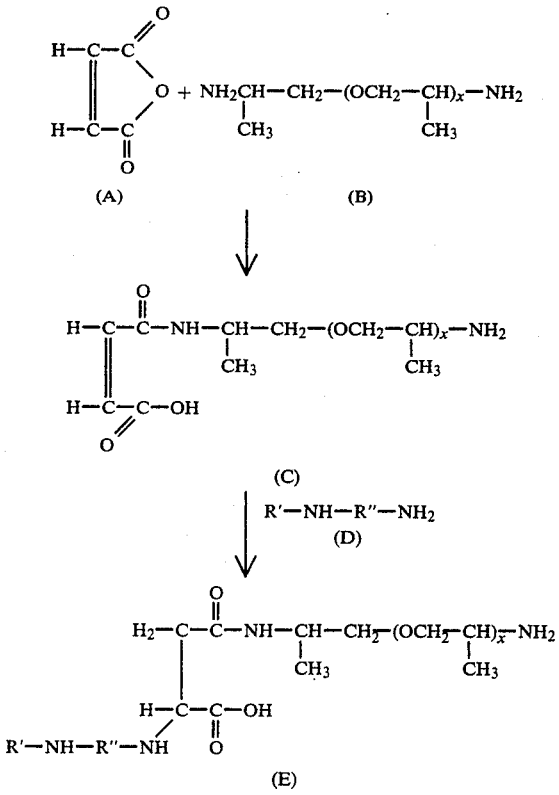

wherein R′ is a $C_8$–$C_{18}$ alkyl, alkaryl, aralkyl, aryl, or cycloalkyl group and R″ may be a ($C_1$–$C_3$) alkylene, aralkylene, alkarylene, arylene, or cycloalkylene group, and x is a numeral of about 2 to about 68.

To prepare the present reaction product, substantially equal molar amounts of a polyoxyisopropylenediamine and maleic anhydride are heated for 2–4 hours at 75° to 150° C. For the purpose of this invention, maleic anhydride and maleic acid are equivalents. Preferably, the maleic anhydride and polyoxyisopropylenediamine are heated in a solvent, such as xylene, which facilitates the formation of the intermediate. To the mixture containing the intermediate product an equal molar amount of a diamine is added and the entire mixture is then heated to effect the reaction. In general, this is done by heating the mixture to about 60°–100° C. The reaction can generally be completed from about 0.1 to 10.0 hours, although a longer time may be required for larger quantities. After the reaction has been completed, the product is filtered and the solvent is stripped away under a vacuum.

The anti-wear additives prepared according to the present invention may be added to fuels (including alcohol, gasoline, gasohol, etc.) or to antifreeze. These compositions may be particularly found to be effective when added to absolute alcohol fuels.

Also, the prepared anti-wear additives may be added to a fuel in a minor wear-inhibiting amount of about 0.003–10.0 weight percent, preferably about 0.01–8.0 weight percent, more preferably about 0.2–6.0 weight percent, and most preferably about 0.5 weight percent.

It is a feature of this invention that the fuel composition is characterized by its increased ability to significantly reduce scar diameters (wear) in the Four Ball Wear Test.

The Four Ball Wear Test is carried out by securely clamping three highly polished steel balls (each 0.5 inch in diameter) in a test cup in an equilateral triangle in a horizontal plane. The fourth highly polished steel ball, resting on the three lower balls to form a tetrahedron, is held in a chuck. A weight lever arm system applies weight to the test cup, and this load holds the balls together. In the standard test, the speed of radiation is 1800 rpm; the load is 5 kilograms. the assembly is submerged in the liquid to be tested. The standard test is carried out at ambient temperature for 30 minutes. As the chuck and upper ball rotate against the fixed lower balls, the friction of the upper ball rotating in relation to the lower balls produces a wear-scar, the diameter of which (i.e., the depth along a diameter of the ball) is measured. The average of the wear on the three lower balls is the rating assigned (in millimeter).

It is observed that the use of the technique of this invention permits reduction in the average scar diameter by as much as 20%–30%. A reduction of 10% is a significant reduction.

In the following Examples, the advantages of the present invention will be apparent.

EXAMPLE I

Preparation of a Polyoxyisopropylenediamine, Maleic Anhydride, And Hydrocarbon Substituted Diamine Reaction Product To a reaction vessel there was added forty-nine (49) parts of maleic anhydride dissolved in 260 parts of xylene, and 57.4 parts of Jeffamine D-230. This mixture was reacted at 100° C. for 2 hours and allowed to cool to 60° C. Then, to this first mixture was added 18 parts of N-tallow-1,3-propane diamine and the entire mixture was reacted at 100° C. for about 1 hour. After this period of time, the reaction product was filtered and stripped of the remaining solvent under a vacuum. The predominate product had a molecular weight of 586.8, a TBN of 286.8, and contained 9.5% nitrogen.

A test formulation was made up containing 100% methanol which contained 0.5 weight percent of the above reaction product. This formulation was subjected to the Four Ball Test. The average scar diameter was about 0.24 mm.

EXAMPLE II

Preparation of a Polyoxyisopropylenediamine, Maleic Anhydride, And Hydrocarbon Substituted Diamine Reaction Product To a reaction vessel, there was added 24.5 parts of maleic anhydride dissolved in 173 parts of xylene, and 102.7 parts of Jeffamine D-400. This mixture was heated at about 100° C. for about 2 hours and allowed to cool to 60° C. To this first mixture, 93.5 parts of N-tallow-1,3-propane diamine were added and the entire mixture was reacted at 100° C. for 1 hour. The reaction mixture was then filtered and stripped of the remaining solvent under a vacuum to provide the product. The predominate product had a molecular weight of 882.7, a TBN of 190.7, and contain 6.3 nitrogen.

A test formulation was made up containing methanol which contained 0.5 weight percent of the above reaction product. This reaction product was subjected to the Four Ball Test. The average scar diameter was about 0.27 mm.

EXAMPLE III

Preparation of a Polyoxyisopropylenediamine, Maleic Anhydride, And Hydrocarbon Substituted Diamine Reaction Product To a reaction vessel there was added 61.3 parts of maleic anhydride dissolved in 172 parts of xylene, and 123 parts of Jeffamine D-2000. This mixture was heated at 100° C. for 2 hours and allowed to cool to 60° C. To this first mixture, 23.4 parts of N-tallow-1,3-propane diamine were added and the entire mixture was reacted at 100° C. for 1 hour. The heating was discontinued and the reaction product was filtered and stripped of the remaining solvent under a vacuum. The predominate product had a molecular weight of 2440.4, a TBN of 69.0, and contained 2.3 nitrogen.

A test formulation was made up containing 100% methanol which contained 0.5 weight percent of the above reaction product. This formulation was subjected to the Four Ball Test and the average scar diameter was 0.25 mm.

EXAMPLE IV

In this Example, the test procedure of Example I was used except there was no additive used. The mixture of the material of this Example is 100% methanol.

A test formulation of each of the products of Examples I, II, and III were made up containing 100% absolute methanol, making up 0.5 weight percent of each product. These formulations, as well as the material of this Example, were subjected to the Four Ball Test and the results are recorded below in Table V.

TABLE V

| EXAMPLE | AVERAGE SCAR DIAMETER (mm) |
|---|---|
| I | 0.24 |
| II | 0.27 |
| III | 0.25 |
| IV | 0.34 |

It is apparent from the results shown in Table V above that the preferred embodiment of the present invention (Example I) increased the wear-inhibiting property of the methanol by over 142 (i.e., 0.34/0.24) and the less preferred embodiment of this invention (Example II) gave a lesser degree of improvement of about 126 (i.e., 0.34/0.27) which is till substantial.

It has been found tht results comparable to those in Example I may be obtained when the added components are as provided in the Examples shown below in Table VI.

TABLE VI

| EXAMPLE | ADDITIVE |
|---|---|
| (V) | 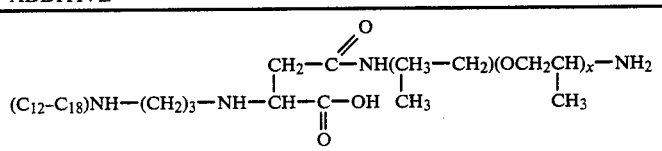 |

(where x is 2 or 3)

TABLE VI-continued

| EXAMPLE | ADDITIVE |
|---|---|
| (VI) | 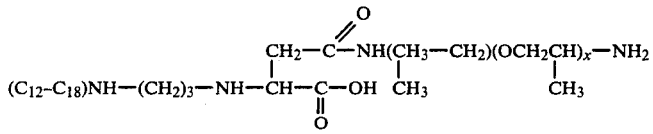 (where x is 5 or 6) |
| (VII) | 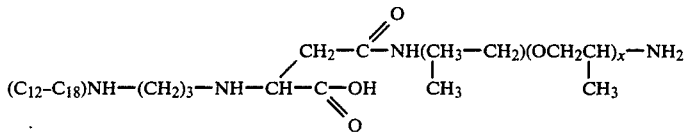 (where x is 33) |
| (VIII) | 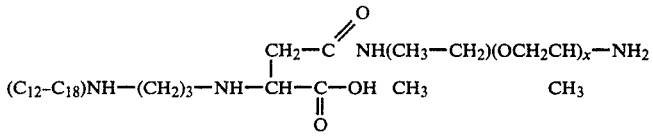 (wherein x is 68) |

Also, results may be comparable to those of Example I, if the fuel used is as those listed below in Table VII.

TABLE VII

| EXAMPLE | FUEL |
|---|---|
| IX | Absolute Methanol |
| X | Methanol/Gasoline Blend (90.5 volume percent gasoline; 4.75 volume percent cosolvent; 4.75 volume percent methanol) |
| XI | Gasohol (90 volume percent gasoline; 10 volume percent ethanol) |

Although this invention has been illustrated by reference to specific embodiments, it will be apparent to those skilled in the art that various changes and modifications may be made clearly following the scope of this invention as defined in the appended claims.

What is claimed is:

1. A fuel composition for an internal combustion engine comprising:

(a) a major portion of a fuel containing (i) a $C_1$–$C_2$ alcohol and (ii) 0–50 volumes of gasoline per volume of alcohol; and (b) from about 0.003 to about 10.0 (w)% of, as a wear-inhibiting additive, a condensate product of the process comprising:

(i) reacting a dibasic acid anhydride with a polyoxyisopropylenediamine

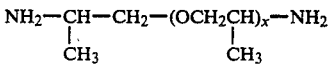

where x is a numeral of about 2 to about 68 at 75° to 150° C. for 2 to 4 hours, thereby forming a maleamic acid;

(ii) reacting said maleamic acid with an N-alkylalkylene diamine at about 60° to 100° C. for about 0.1 to 10.0 hours, thereby forming a condensate product; and (iii) recovering said condensate product.

2. The fuel composition of claim 1, wherein said polyoxyisopropylenediamine has a molecular weight $\overline{M}_n$ ranging from about 100 to about 4000.

3. The fuel composition of claim 1, wherein said polyoxyisopropylenediamine, x is a numeral of about 2 to about 33.

4. The fuel composition of claim 1, wherein said dibasic acid anhydride has the formula

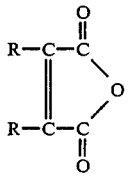

where R is H, $CH_3$— or $C_2H_5$—.

5. The fuel composition of claim 1, wherein said diamine has the formula $$R'—NH—R''—NH_2$$

where R′ is a $C_8$–$C_{18}$ hydrocarbon group and R″ is a divalent $C_1$–$C_3$ hydrocarbon group.

6. The fuel composition of claim 1, wherein the minor wear-inhibiting amount ranges from about 0.2 to about 6.0 (w)%.

7. The fuel composition of claim 1, wherein the minor wear-inhibiting amount is about 0.5 (w)%.

8. The fuel composition of claim 1, wherein said fuel contains about 0.0001 to about 0.05 (v)% of water.

9. The fuel composition of claim 8, wherein said fuel contains about 0.04 (v)% of water.

10. A fuel composition for an internal combustion engine comprising:

(a) a major portion of a fuel containing (i) a $C_1$–$C_2$ alcohol and (ii) 0–50 volumes of gasoline per volume of alcohol; and (b) a minor wear-inhibiting amount of, as a wear-inhibiting additive, a condensate product of the process comprising:

(i) reacting a polyoxyisopropylenediamine

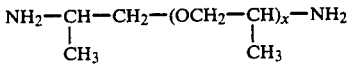

where x is a numeral of about 2 to about 68, with a dibasic acid anhydride

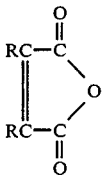

thereby forming a maleamic acid;

(ii) reacting said maleamic acid with an N-alkyl-alkylene diamine $R'—NH—R''—NH_2$ where R′ is a $C_8$–$C_{18}$ hydrocarbon group and R″ is a divalent $C_1$–$C_3$ hydrocarbon group, thereby forming a condensate product

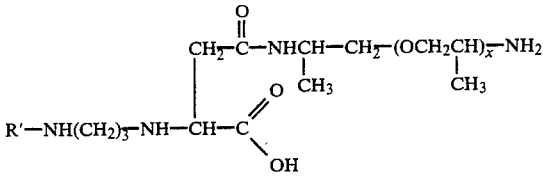

where x is a numeral of about 2 to about 68; and (iii) recovering said condensate product.

11. The fuel composition of claim 10, wherein the minor wear-inhibiting amount ranges from about 0.003 to about 10.0 (w)%.

12. The fuel composition of claim 11, wherein the minor wear-inhibiting amount ranges from about 0.2 to about 6.0 (w)%.

13. The fuel composition of claim 11, wherein the minor wear-inhibiting amount is about 0.5 (w)%.

14. The fuel composition of claim 10, wherein said fuel contains about 0.0001 to abut 0.05 (v)% of water.

15. The fuel composition of claim 10, wherein said fuel contains about 0.04 (v)% of water.

16. A fuel composition for an internal combustion engine comprising:

(a) a major portion of a fuel containing (i) methanol and (ii) 45 volumes of gasoline per volume of methanol; and (b) about 10 (w)% of a wear-inhibiting condensate product of the process comprising:

(i) reacting a polyoxyisopropylenediamine

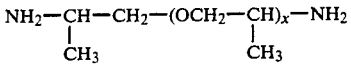

where x is a numeral of about 2 to about 68 with a maleic anhydride, thereby forming a maleamic acid

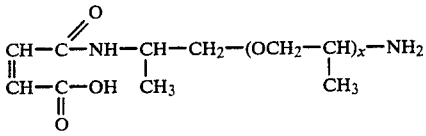

(ii) reacting said maleamic acid with N-tallow-1,3-propane diamine, thereby forming a condensate product

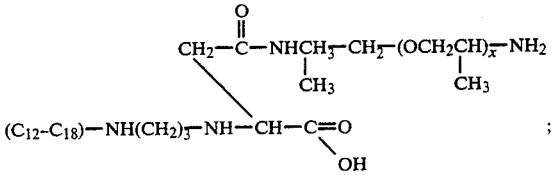

;

and (iii) recovering said condensate product.

* * * * *